United States Patent [19]

Hung

[11] Patent Number: 4,496,804

[45] Date of Patent: Jan. 29, 1985

[54] WIRE CONTACT RETENTION MEANS FOR ROTARY SWITCHES

[75] Inventor: Peter Hung, Huntington, N.Y.

[73] Assignee: Porta Systems Corp., Syosset, N.Y.

[21] Appl. No.: 521,697

[22] Filed: Aug. 10, 1983

[51] Int. Cl.[3] ..... H01H 19/58

[52] U.S. Cl. ..... 200/11 A; 200/243

[58] Field of Search ..... 200/11 A, 11 G, 237, 200/238, 155 R, 243, 273, 250

[56] References Cited

U.S. PATENT DOCUMENTS 4,410,773 10/1983 DeLuca et al. ..... 200/11 G X

*Primary Examiner*—A. D. Pellinen

*Assistant Examiner*—Morris Ginsburg

*Attorney, Agent, or Firm*—Charles E. Temko

[57] ABSTRACT

An improvement for retaining wire type contacts of a rotary switch in position upon a stator to facilitate assembly during manufacture. In lieu of previously employed glued or heat sealed construction, the improvement is provided with a resiliently expandable periphery which engages an annular shoulder on the stator element without resort to the use of tools or adhesives.

2 Claims, 5 Drawing Figures

WIRE CONTACT RETENTION MEANS FOR ROTARY SWITCHES

BACKGROUND OF THE INVENTION

This invention relates generally to the field of rotary type data switches of a device disclosed in copending application Ser. No. 424,212, filed Sep. 27, 1982, and assigned to the same Assignee as the instant application. More particularly, the invention relates to an improved means for retaining wire type contacts in engaged condition upon a base or stator element prior to assembly of the component parts of the switch.

In the above identified application there is disclosed a switch construction including a base element or stator which mounts a large plurality of individual wire contacts at the periphery thereof, which contacts are bridged by other contacts located on another surface of a pivotally associated rotor. The contacts are of generally L-shaped configuration with one leg extending radially inwardly to form a deflectable surface contacting the bridging contacts on the rotor. The other leg is inserted into one of a plurality of axially positioned bores in the base or stator where it is either cementitiously anchored or maintained in position by a retaining ring which is in turn cemented in position on the stator. With the use of either alternative, a substantial period of time is required for the setting of the adhesive, with an accompanying danger that excess adhesive will flow to the contact surfaces on the individual contact wires.

SUMMARY OF THE INVENTION

Briefly stated, the invention contemplates the provision of a contact retaining ring performing the same function as the corresponding prior art structure which may be more conveniently installed with a manually imparted resilient snap action to provide a permanent means for retaining the wire contacts in operational position without the use of adhesives or heat sealing, following which the completed stator may be immediately assembled with a corresponding rotor element to form a completed switch. The novel construction includes a retaining ring having a resiliently expandable segmented peripherally positioned skirt which engages upon an annular shoulder on the rotor element to secure it in position.

BRIEF DESCRIPTION OF THE DRAWING

In the drawing, to which reference will be made in the specification, similar reference characters have been employed to designate corresponding parts throughout the several views.

FIG. I is a perspective view of an embodiment of the invention.

Figure 1:
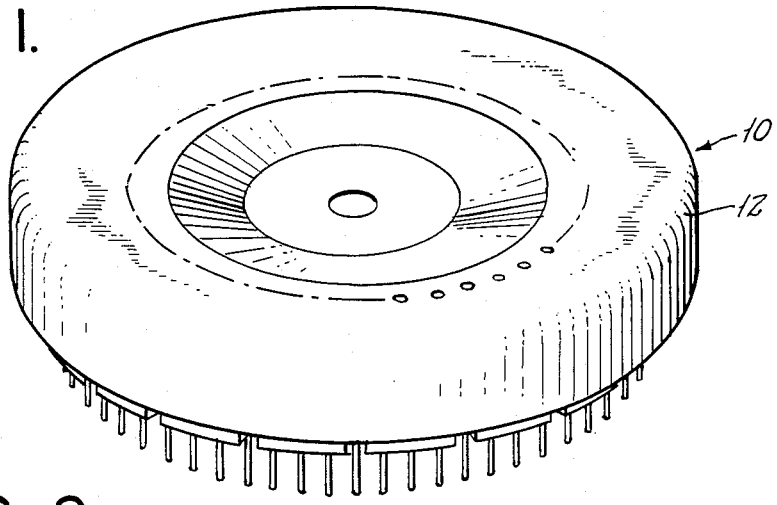

FIG. II is a fragmentary central sectional view thereof.

FIG. III is a side elevational view thereof, partly in section.

FIG. IV is a fragmentary top plan view thereof.

FIG. V is a fragmentary perspective view thereof.

DETAILED DESCRIPTION OF THE DISCLOSED EMBODIMENT

In accordance with the invention, the device, generally indicated by reference character 10, comprises broadly: a base or stator element 11 and an associated rotor element 12.

The base element 11 is preferably of molded synthetic resinous construction, and includes a main body member 20 bounded by an upper surface 21, a lower surface 22, an outer peripheral edge 23, and a central bore 24 which provides means for pivotally interconnecting the rotor element 12. A plurality of peripherally arranged bores 25 each accommodates individual L-shaped wire contacts 26, the contacts including a first axially disposed portion 27, interconnected by a bent portion 28 to a radially inwardly projecting portion 29. The outer end of each of the contacts 26 engages a channel formed by septums 31 as is known in the art. The stator includes an annular rabbet 32 forming a continuous shoulder 33.

Maintaining the contacts 26 in position is an annular retaining ring 35 having a generally L-shaped cross section including a radially extending portion 37, and an axially extending portion 38 The portion 37 is bounded by an upper surface, a lower surface 41, and an inner peripheral surface 42. An angularly disposed transition portion 43 is bounded by outer and inner surfaces 44 and 45, respectively, which are disposed at substantially a forty five degree angle.

Figure 2:
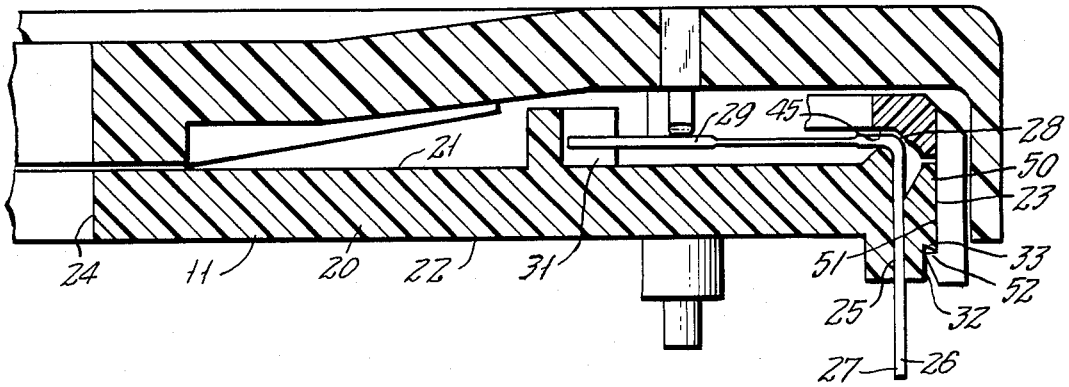
Figure 3:
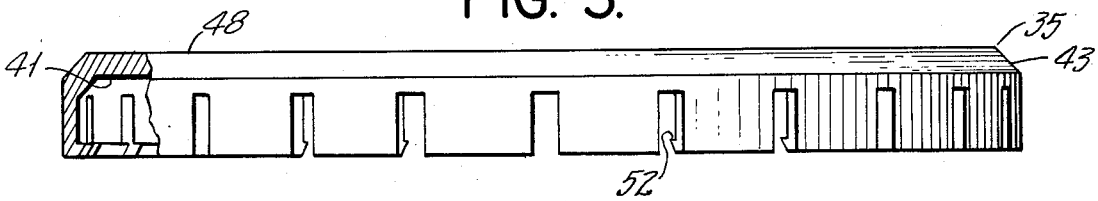
Figure 4:
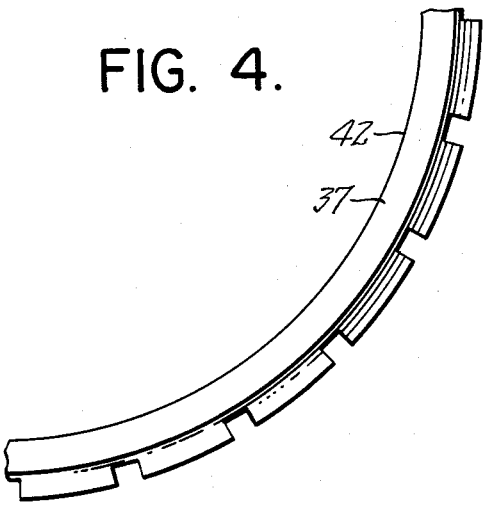
Figure 5:
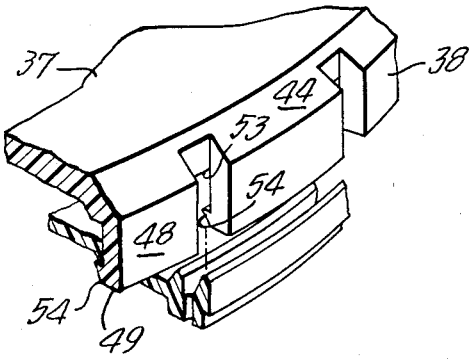

The axially extending portion 38 is castellated to permit limited expansion and contraction in a radial direction, and is bounded by an outer surface 48, an end surface 49, and an inner surface 50 into which a recess 51 is formed bounded by first and second radially extending surfaces 52 and 53. An angularly disposed cam surface 54 serves as a means for expanding the individual segments slightly so that they may be seated in the position shown in FIG. 2. Because each of the castellated segments contributes to retention in engaged position, the degree of radial expansion necessary for each may be of a relatively small order, approximating 0.025 inch.

During assembly of the stator element 11, the contacts 26 may be manually inserted into position as known in the art. Instead of using a cemented or heat sealed retaining ring, in accordance with the present invention, it is necessary only to fit the ring 35 into position by laying it on top of the stator and pressing downwardly with a moderate degree of force sufficient to obtain engagement.

I wish it to be understood that I do not consider the invention limited to the precise details of structure shown and set forth in this specification, for obvious modifications will occur to those skilled in the art to which the invention pertains.

I claim:

1. In a wire contact rotary type switch including a stator having a plurality of L-shaped wire contacts positioned in corresponding peripherally located bores, and a retaining ring engaged upon said stator at the periphery thereof to retain said contacts within said bores, the improvement comprising: said stator having a peripheral edge portion disposed outwardly of said bores defining a transversely extending shoulder, said retaining ring including a radially extending portion contacting said wire contacts and an axially extending peripheral portion defining a recess, said axially extending portion being radially expandable to enable it to be forced over said shoulder, and upon contraction to engage the same.

2. The improvement in accordance with claim 1, further characterized in said axially extending portion consisting of a plurality of individual segments capable of expansion and contraction in a radial direction.

* * * * *